US007530859B2

(12) United States Patent
Moll et al.

(10) Patent No.: US 7,530,859 B2
(45) Date of Patent: May 12, 2009

(54) ELECTRICAL CONTACT

(75) Inventors: Hurley Chester Moll, Hershey, PA (US); John Wesley Hall, Harrisburg, PA (US); John Mark Myer, Millersville, PA (US); Barry Gene Burkepile, Kernersville, NC (US); Leo Joseph Graham, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/875,426

(22) Filed: Oct. 19, 2007

(65) Prior Publication Data

US 2008/0280510 A1 Nov. 13, 2008

Related U.S. Application Data

(60) Provisional application No. 60/928,178, filed on May 8, 2007.

(51) Int. Cl.
*H01R 13/11* (2006.01)

(52) U.S. Cl. ..... 439/852

(58) Field of Classification Search ..... 439/852, 439/842, 843, 844, 851, 853, 856, 857, 862
See application file for complete search history.

(56) References Cited

U.S. PATENT DOCUMENTS

| | | | | |
|---|---|---|---|---|
| 6,386,928 | B2 * | 5/2002 | Kitamura | 439/852 |
| 2001/0002350 | A1 * | 5/2001 | Kashiyama et al. | 439/848 |
| 2007/0099520 | A1 * | 5/2007 | Anbo et al. | 439/852 |

* cited by examiner

*Primary Examiner*—Ross N Gushi

(57) ABSTRACT

An electrical contact includes a mating portion and a crimp portion connected by a transition region. The mating portion is configured to receive a mating external contact pin. The mating portion has a top wall and a bottom wall joined by opposing side walls. The top, bottom and side walls form a contact box open at one end. The contact box includes a contact beam that extends through the contact box, a front flap portion and a front aperture for insertion of the mating contact, and a back aperture adjacent to the transition region. The front flap portion protrudes partially into the front aperture forward of the contact beam to prevent a free end of the contact beam from receiving a direct impingement force when mating the electrical contact with the second electrical contact.

19 Claims, 11 Drawing Sheets

ELECTRICAL CONTACT

CROSS REFERENCE TO RELATED APPLICATIONS

This application claims the benefit of U.S. Provisional Application No. 60/928,178 filed May 8, 2007.

FIELD OF THE INVENTION

The invention relates to electrical contacts, and more particularly to wire contacts for use with sealed connectors.

BACKGROUND OF THE INVENTION

Currently electrical contacts or wire contacts are used to terminate a wire. Wire contacts require a strong mechanical means of attaching to the wire to create a permanent termination and a means to mate to a mating contact to form an electrical connection. For example, a wire contact may have a crimp end for terminating the wire and a male or female mating end to a mating contact. Some contacts have been developed from metal strips or pre-plated metal strips, which are stamped and then folded or formed into the appropriate shape. These contacts have a generally box shaped mating end for mating to a contact having a pin or blade type mating end. Contacts with a boxed shaped mating end have external size and shape requirements to fit into a cavity of a connector and an internal design for providing the mechanical and electrical connection means for receiving and holding the pin or blade contact of the mating contact. In current contacts having generally boxed shaped mating ends, a contact or compliant beam may be the means to receive and hold the mating pin contact.

However, when inserting or extracting a box-shaped mating end of a contact from the connector cavity, the sharp edges on the box-shaped mating end may damage a seal used on sealed connectors. Additionally, some contact designs may not provide the preferred mating force for inserting the pin contact into the box mating end, or the preferred contact normal force during use. Further, terminal boxes that are too large may stretch and pinch seal glands, as the large rectangular box is inserted into a smaller, round aperture of the seal, causing the seal glands to stretch to a point that the seal is compromised.

In some prior art connectors, contact beams may have a high spring force, which decreases the ability to control the normal force applied by the contact beam, increasing the mating force of the connector, and increasing tolerance sensitivity. Other connector problems may arise from having the contact beam exposed to the mating pin, leaving the contact beam unprotected from damage from external factors.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

The solution is provided by an electrical contact of the present disclosure that provides seal friendly features and a contact beam which is not exposed to the insertion of the mating contact and thus protects the contact beam from damage. The contact comprises a front flap that protects the contact beam from stubbing during inserting of a pin contact and an angled front or leading edges of the contact box which provides a leading surface for insertion of the contact through a seal to reduce any seal damage. In a preferred embodiment, the contact of the present disclosure may also comprise a rear fold over flap and rear angled edges to provide a surface for leading a seal on extraction of the contact from the connector.

In one embodiment, the invention is directed to an electrical contact. The electrical contact includes a mating portion, a crimp portion, and a transition region connecting the mating portion with the crimp portion. The mating portion includes a top wall and a bottom wall joined by two opposing side walls. The top, bottom and two side walls form a contact box open at least one end. The contact box is configured to accept a mating second electrical contact. The contact box further includes a contact beam extending therethrough, a front fold over flap and a front end aperture for insertion of a mating contact, and a back end adjacent to the transition region. The front fold over flap protrudes partially into the front end aperture forward of the contact beam to prevent a free end of the contact beam from receiving a direct impingement force when mating the electrical contact with the second electrical contact.

One advantage of the present invention is the ability to minimize seal damage during terminal insertion/extraction.

Another advantage of the present invention is reduced force required for the connector to receive a mating pin.

A further advantage of the present invention is a connector that reduces the need for multiple connections to devices. By decreasing the mating force, more contacts per connector can be achieved, resulting in fewer connectors needed if each connector can have a greater number of terminals.

Yet another feature of the present invention is a compliant beam geometry that provides improved overstress protection, which includes a forward fold-over flap on the bottom of box that prevents physical damage to the contact beam by preventing stubbing when mating the connector and with a pin.

A further advantage of the present invention is the inclusion of a tapered embossment. The tapered embossment is formed on the contact beam and distributes mechanical stresses away from base of beam, to provide the desired contact normal force with less set. Further, redundant overstress features on opposite sides are provided Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, like reference numerals are used to refer to like elements throughout the application.

DETAILED DESCRIPTION OF THE INVENTION

Before turning to the figures, which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
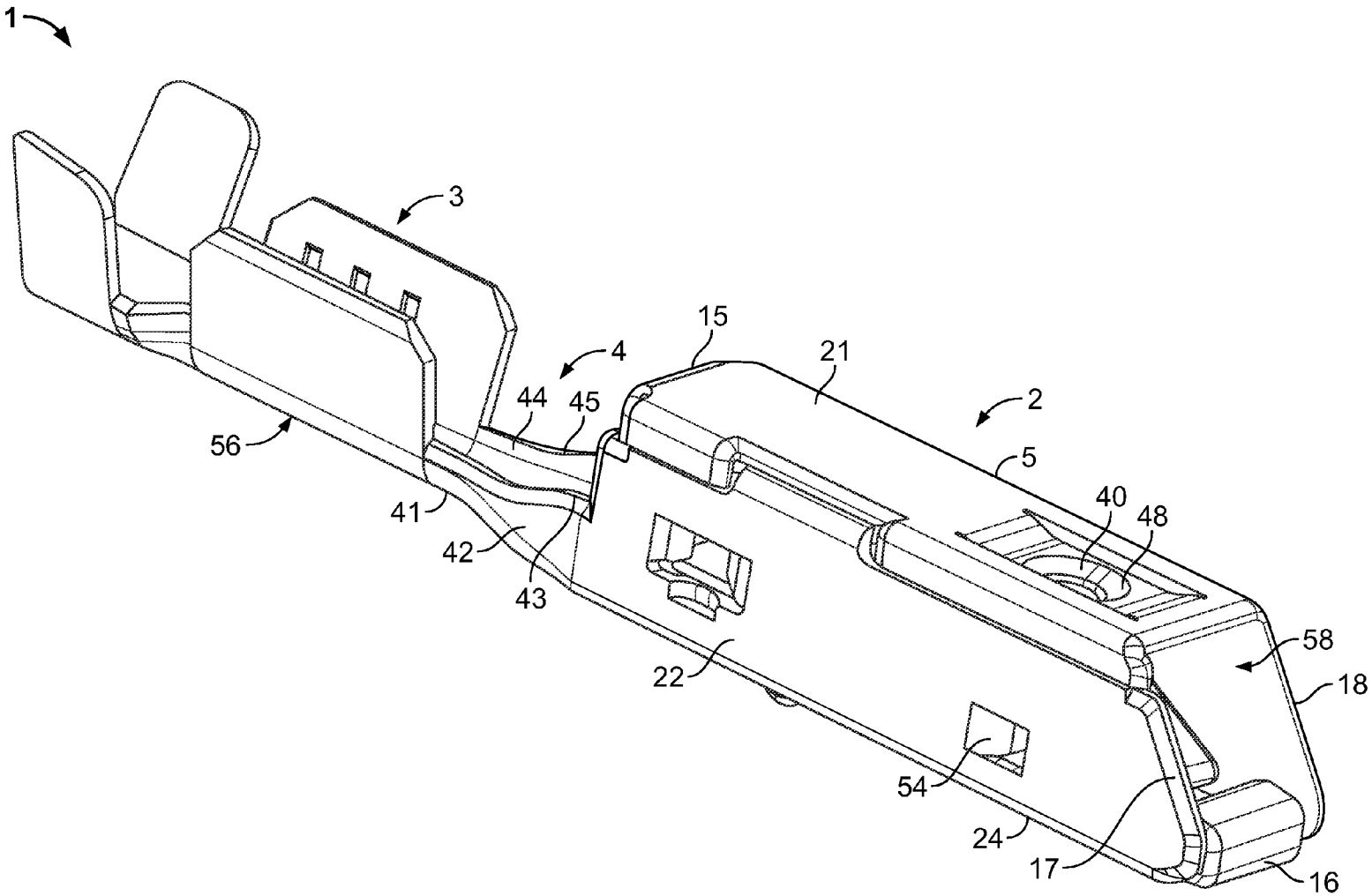
FIG. 1 shows a perspective side view of an exemplary embodiment of the contact of the present invention.
Figure 2:
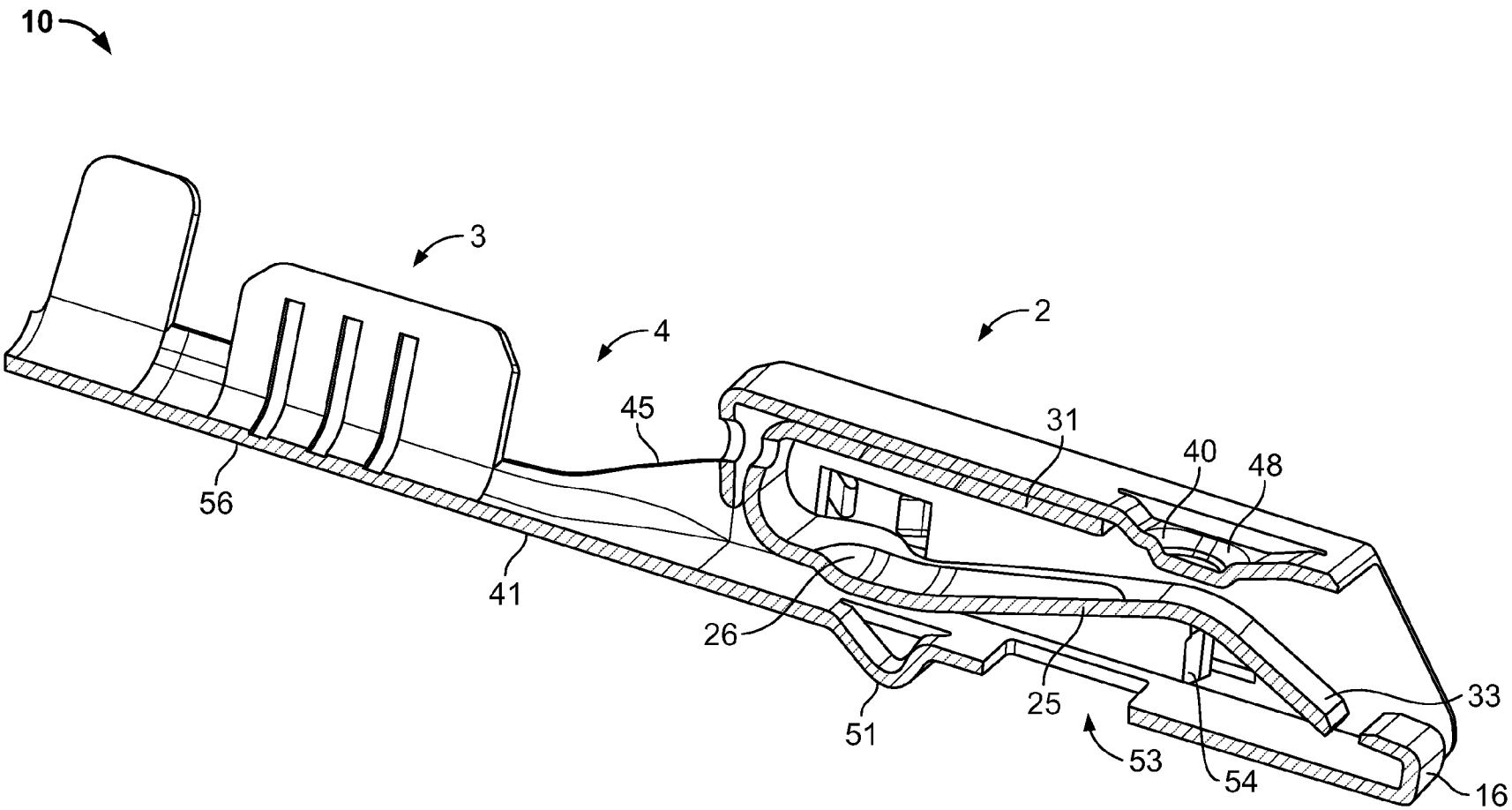
FIG. 2 shows a cross-section side view taken through the center of the contact box of FIG. 1.
Figure 3:
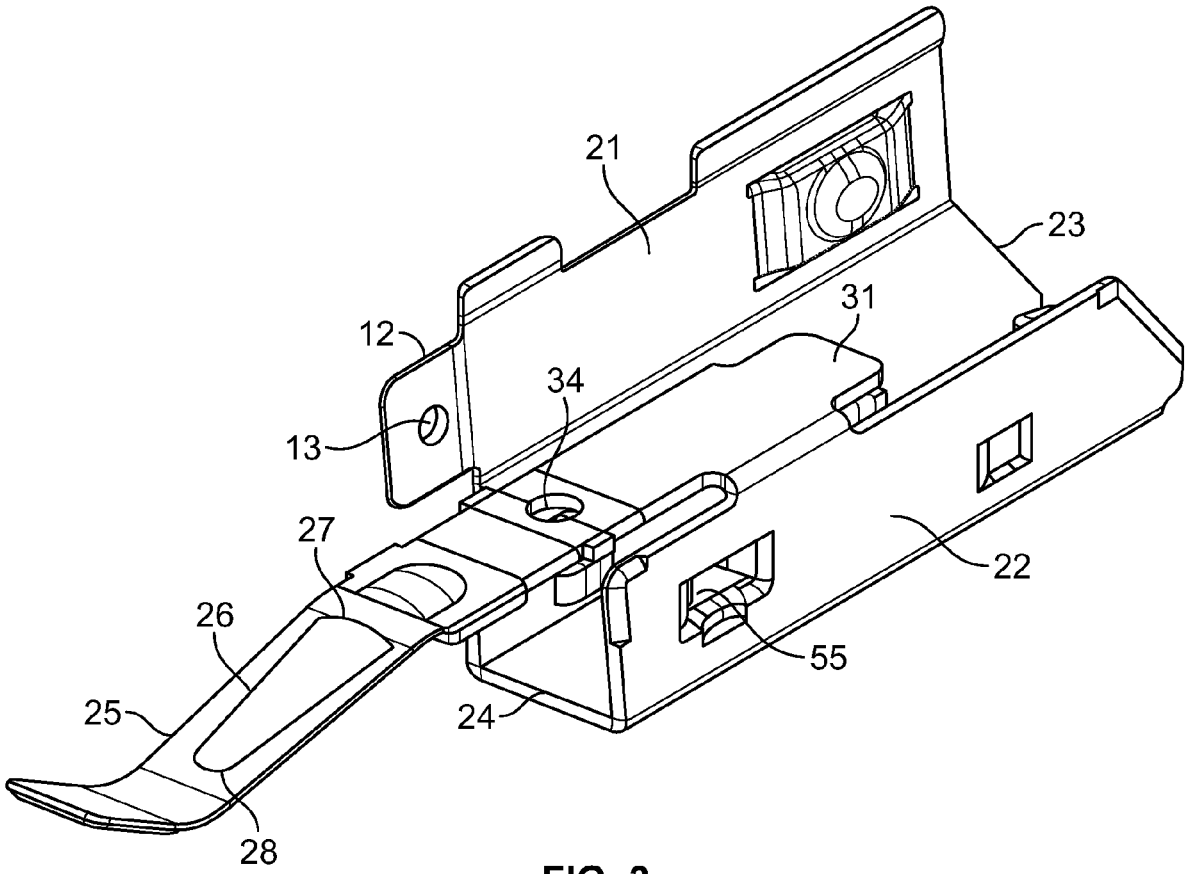
FIG. 3 shows a perspective view of the contact box 5 of the contact of FIG. 1 partial formed.
Figure 4:
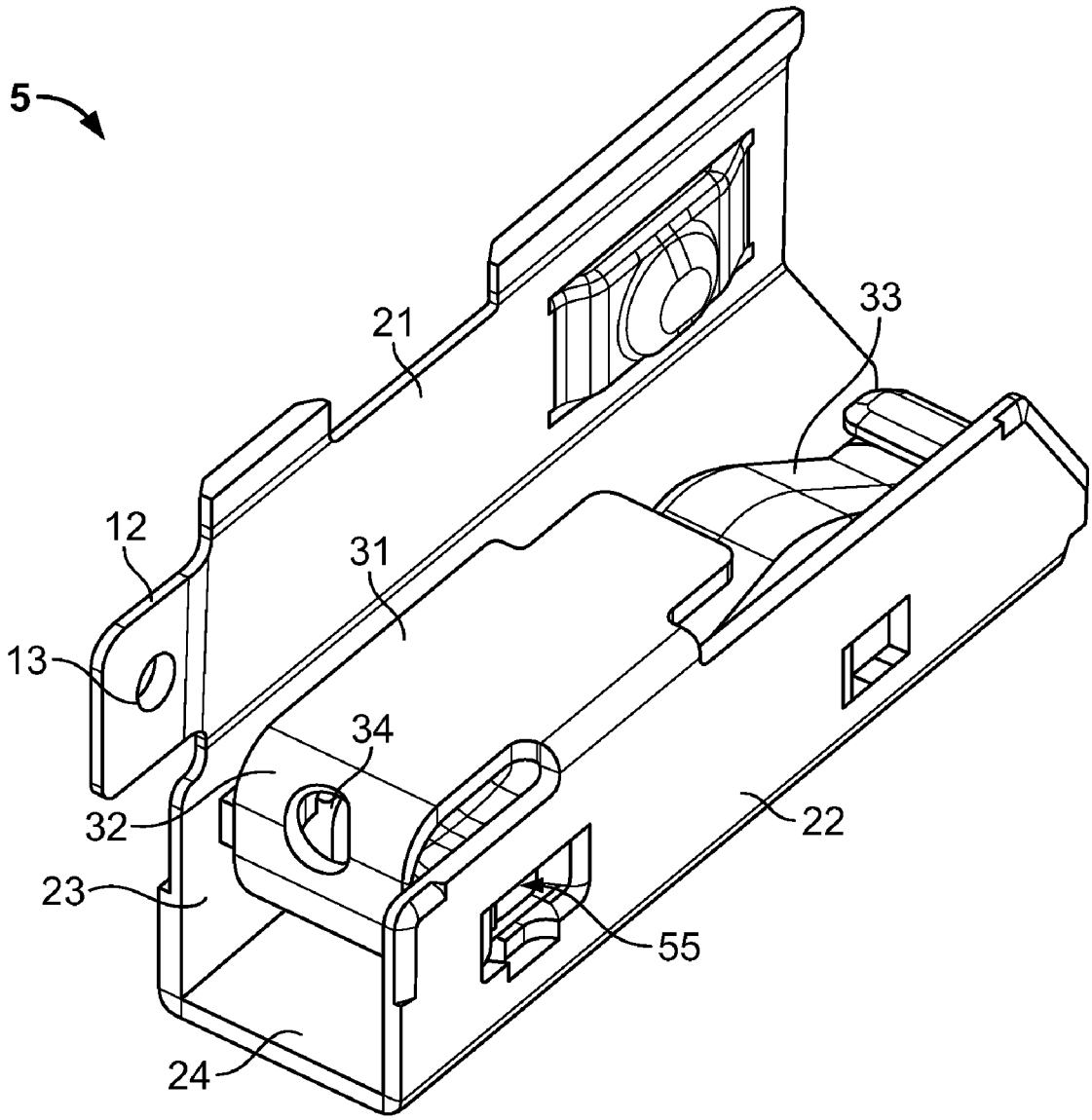
FIG. 4 shows a perspective view of the contact box 5 of FIG. 3 with the contact beam formed.
Figure 11:
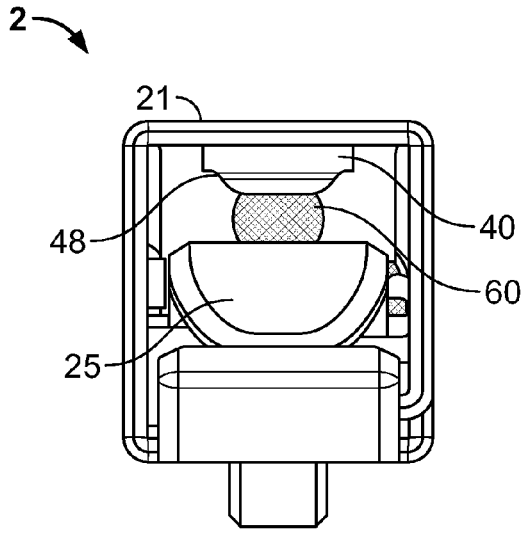
FIG. 11 shows an end view of the mating portion of the contact, with the contact pad engaged with a contact pin.

Referring generally to FIGS. 1-5, an electrical contact 1 includes a mating portion 2, a crimp portion 3 and a transition portion or region 4. The mating portion 2 includes a contact box 5 for accepting a mating pin contact 60 (FIG. 11). As shown in the exemplary embodiment, the mating portion 2 is generally a box shape having a top wall 21, two side walls 22 and 23, and a bottom wall 24. The mating portion 2 further includes a contact beam 25 that may be formed from the same sheet of material from which the contact box 5 is formed. Alternately, the contact beam 25 may be formed separately and inserted into the contact box 5. The contact beam 25 extends substantially the entire length of the contact box 5, which allows the contact beam 25 to be compliant in response to insertion forces. As shown in FIGS. 3 and 4, in the exemplary embodiment, the contact beam 25 is formed from a top flap portion 31 extending from side wall 22, and being folded beneath the top wall 21 of the box 5. In other words, a sheet of metal is stamped so that when the metal is subsequently folded, the contact beam 25 is formed and the four walls 21, 22, 23, 24 of the contact box 5 are then formed around the contact beam 25.

Figure 7:
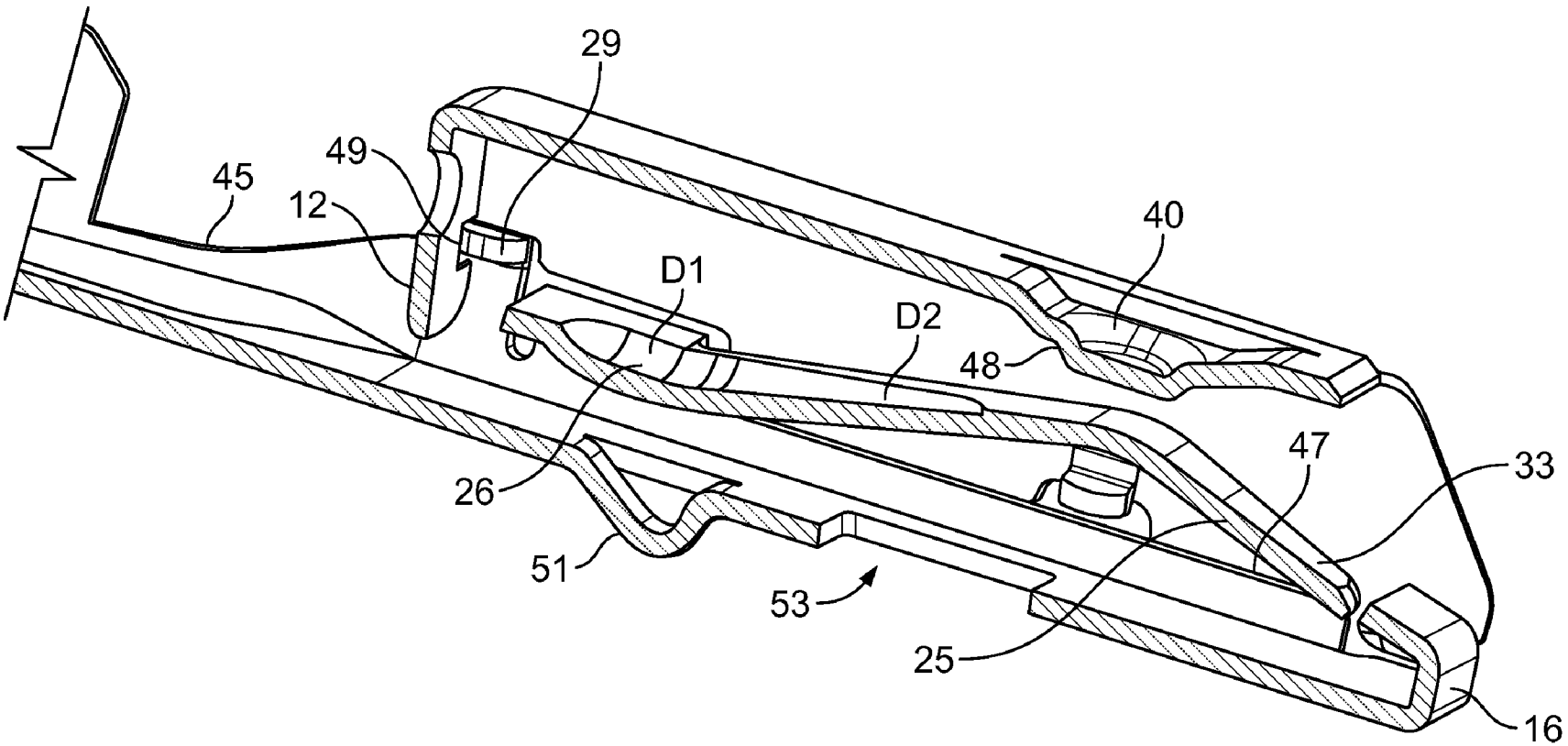
FIG. 7 shows a cross-section side view taken through the center of the contact box of FIG. 6.
Figure 10:
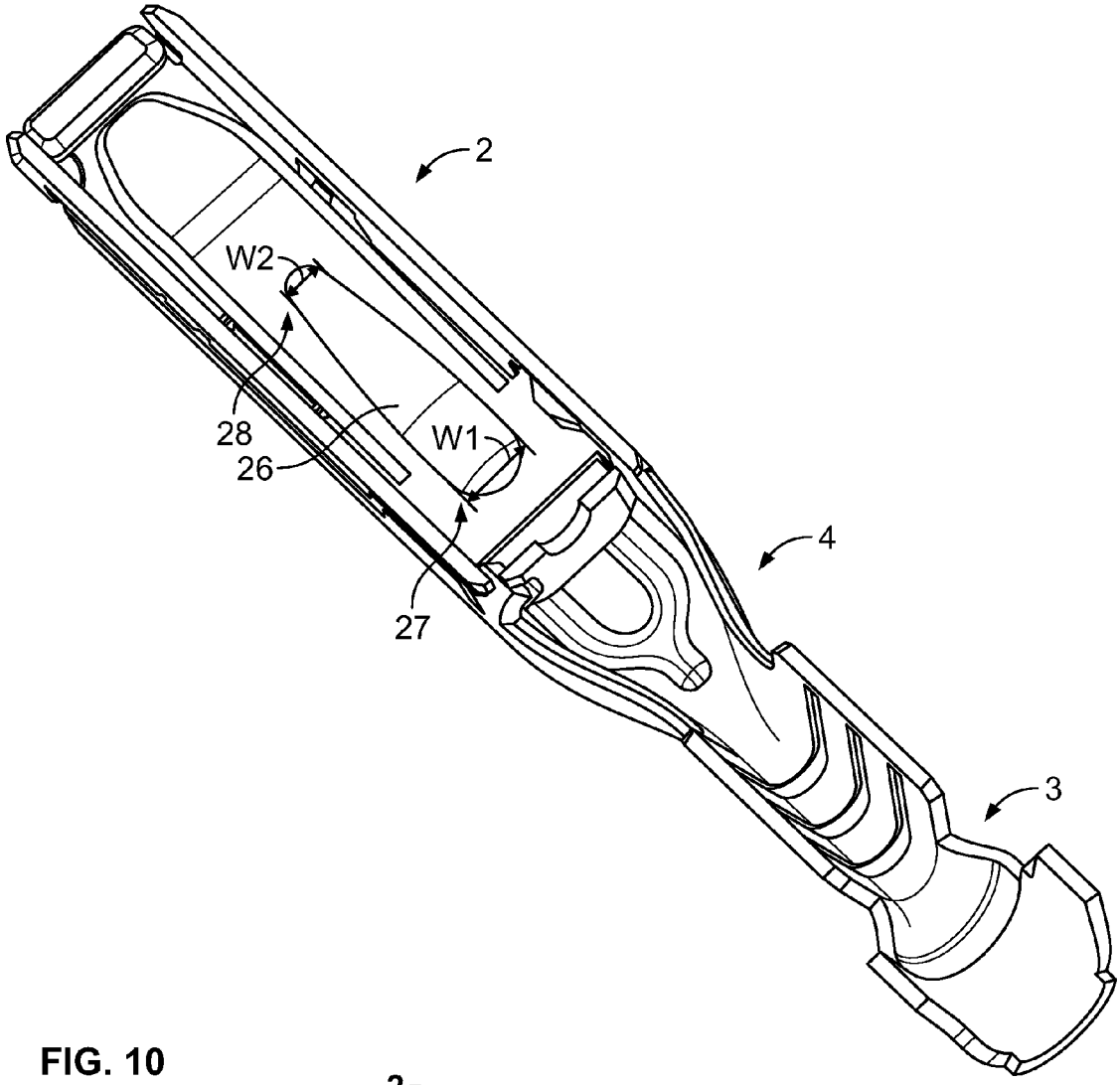
FIG. 10 shows a partial plan view of the contact, with the embossment dimensions.

The contact beam 25 may include an embossment rib 26 to provide increased beam stiffness to achieve the desired normal force for the insertion of a mating pin contact (not shown). The embossment rib 26 is tapered along its longitudinal axis, and has a width W1 at the back end 27 wider than width W2 at the front end 28 (FIG. 10). It should be noted that, depending on the material used, W1 and W2 may vary in width, and in some cases they will be of equal width. The embossment 26 is also tapered in a transverse direction from a depth D1 at the back end 27 to a smaller depth D2 at the front end 28 (FIG. 7). The tapered embossment 26 provides a distribution of mechanical stresses so that a larger portion of the beam is used for the normal force. This reduces or eliminates the need for an assist spring to help create the required normal force for mating.

Figure 5:
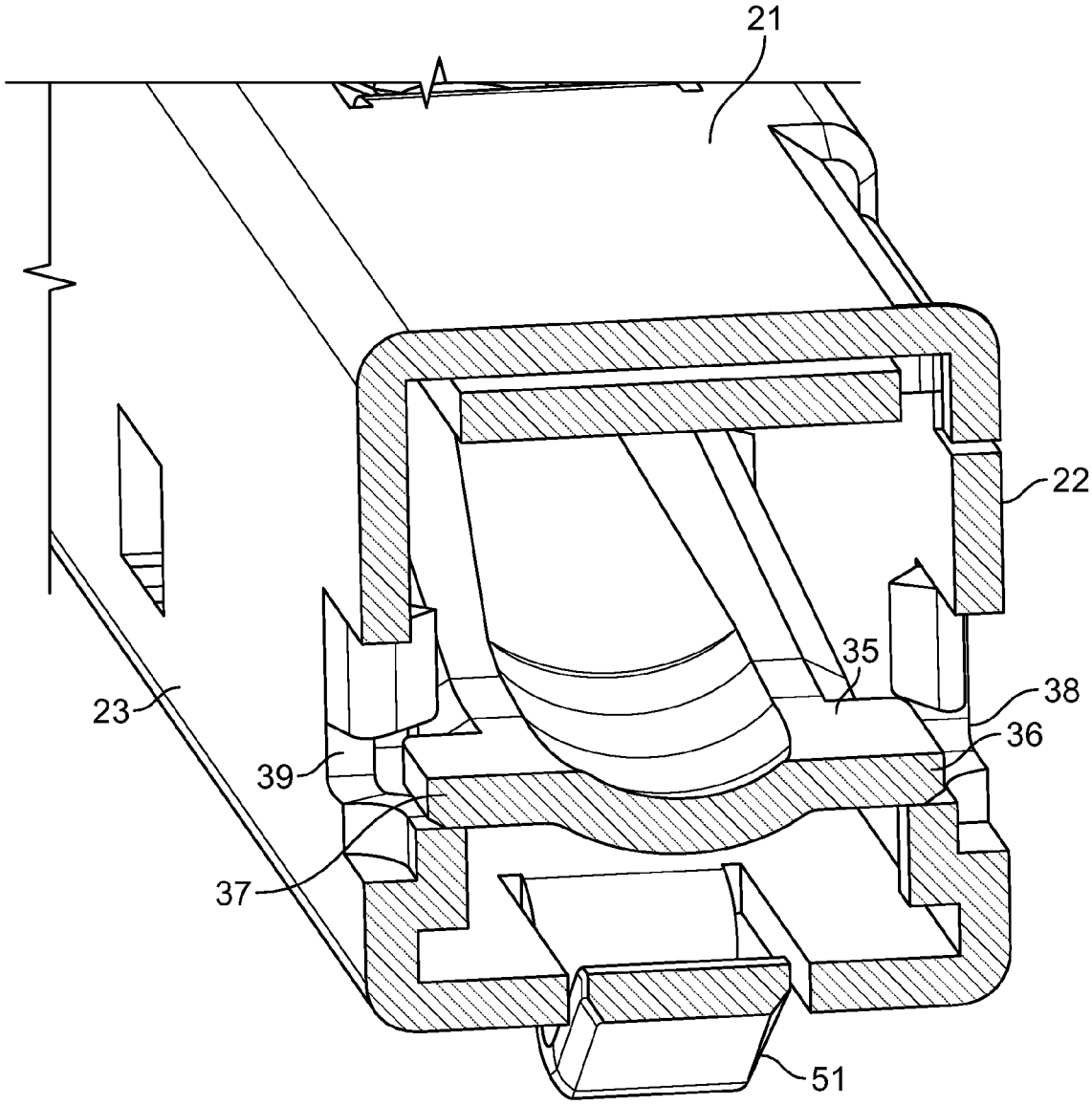
FIG. 5 shows a cross-section view of the contact beam locking feature taken along the lines 5-5 in FIG. 1.
Figure 6:
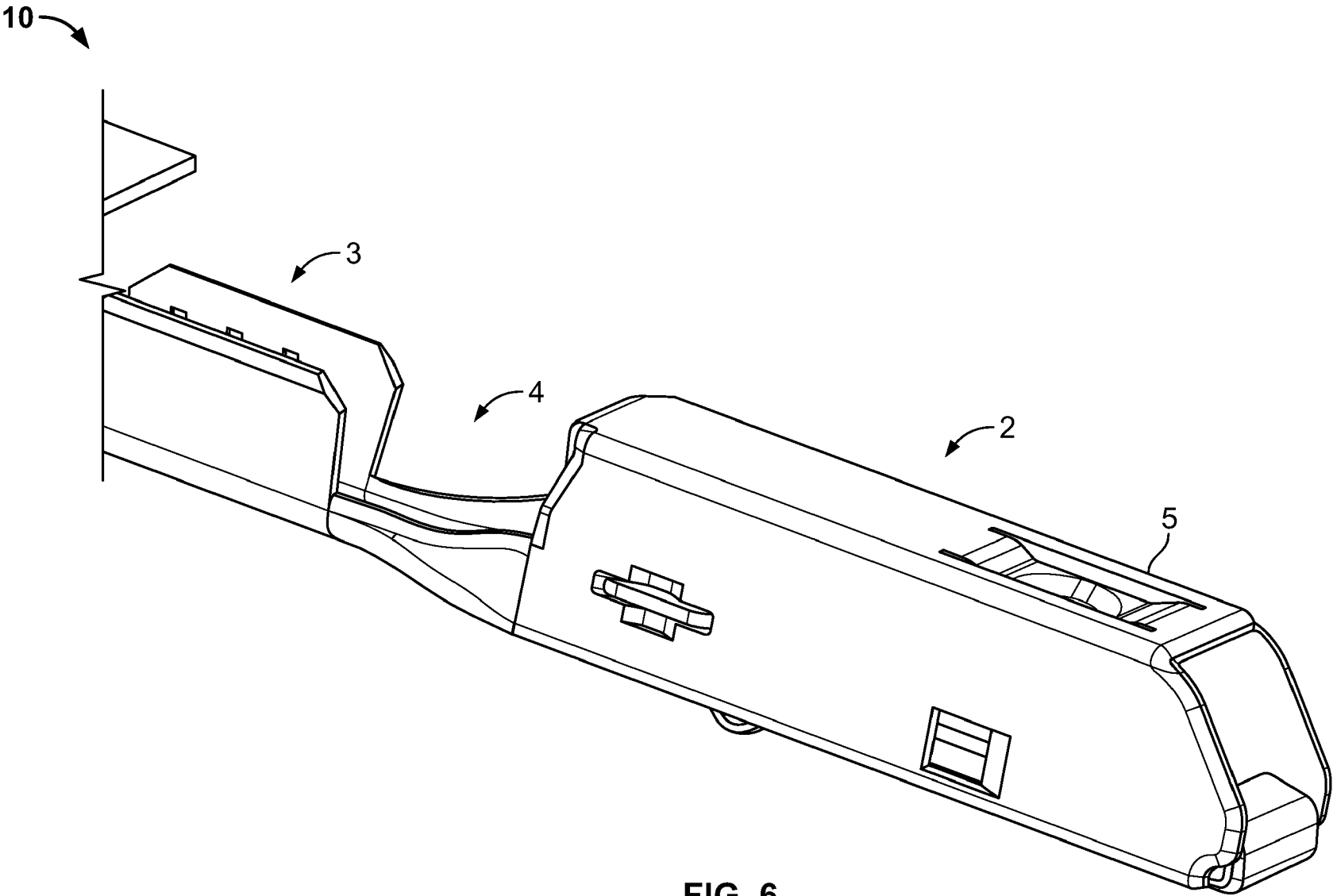
FIG. 6 shows a perspective view of an alternative embodiment of the contact of the present invention.

As shown in FIGS. 2-4, the contact beam 25 includes a top flap portion 31, a back section 32 and an interface section 33. The top flap portion 31 is located under the top wall 21 of the mating portion 2 of the contact 1. The back section 32 is folded substantially perpendicular to the top flap portion 31. As best shown in FIG. 4, the back section 32 includes a hole 34, which allows light to be projected through the rear of the contact box 5 so that the beam gap G1 can be measured during production. The interface section 33 is folded substantially perpendicular from the back section 32 to extend between the top wall 21 and bottom wall 24, and adjacent side walls 22, 23, of the contact box 5. The contact beam 25 is secured inside the contact box 5 with a locking feature 35. As shown in FIG. 5, the locking feature 35 locks the contact beam 25 into both the side walls 22, 23 of the contact box 5. The locking feature 35 includes a first and second wing 36, 37 on either side of the contact beam 25. The first and second wings 36, 37 are fit into corresponding first and second openings 38, 39, respectively, in the side walls 22, 23 of the contact box 5. An orientation element 51 may be provided along the bottom wall 24 to make sure that the contact beam 25 is in proper orientation with respect to a mating contact pin 60 (FIG. 11). Further, a secondary interlocking aperture 53 may be provided in the bottom wall 24 just ahead of orientation element 51, for a receiving an independent locking tab associated with a socket housing (not shown). Finally, tabs 54 and 55 protrude inward from side walls 23, 22, respectively, as shown in FIG. 5, to provide a travel limit or overstress protection for contact beam 25 and interface section 33.

Referring again to FIGS. 3 and 4, the top wall 21 includes a rear flap 12. The rear flap 12 folds over the back section 32 of the contact beam 25 from the top wall 21 of the contact box 5. The rear flap 12 also includes a hole 13 that is aligned with hole 34 on the back section 32. As will be described in more detail below, the rear flap 12 provides a smooth surface for exposure to a seal when the contact 1 is extracted from a connector cavity. This helps prevent damage to the seal.

Again referring to FIGS. 1 and 2, the transition region 4 extends between the mating portion 2 and the crimp portion 3. The transition region 4 includes a bottom wall 41 extending from the bottom wall 24 of the contact box 5 to the bottom wall 56 of the crimp portion 3. The transition region 4 has a first side wall 42 extending from the bottom wall 41 to a top edge 43, and a second side wall 44 disposed opposite the first side wall 42. The second side wall 44 extends from the bottom wall 41 to a top edge 45. As further shown in FIGS. 1 and 2, the transition region 4 top edges 43, 45 of the side walls 41, 42 are angled from a low point adjacent to the crimp portion 3 to the apex where the side walls 42, 44 merge into side walls 22, 23, respectively, at the rear face 15 of the contact box 5. Along with the rear flap 12, the angled top edges 43, 45 provide a leading surface for smoothly extracting the contact box 5 through a seal to reduce the damage to the seal. The angled top edges 43, 45, partially deform inward from the side walls 42, 44 when crimped, to help shield wire strands in the cable from coming in contact with the seal. The angled top edges 43, 45, also increase the bend strength of the crimp.

In one embodiment the top edges 43, 45 may be coined or rounded to further avert damaging seal members when the contact box 5 penetrates a seal opening.

Contact 1 includes a rounded front fold over flap 16. The front fold over flap 16 protects the contact beam 25 from being damaged by a mating pin contact 60 during insertion of the mating pin contact into the contact box 5. The flap 16 prevents interference during mating insertion, and provides a location for a continuity probe. Additionally, the front fold over flap 16 provides a rounded or contoured surface that first contacts a seal, when the contact 1 is inserted into a sealed connector. The contoured surface reduces pinching or stretching of the seal and thus reduces the chance of damaging the seal.

The contact 1 also includes angled front lead in edges 17, 18 to provide a smooth lead-in at the top of the contact box 5 to further reduce seal damage. In the exemplary embodiment, contact box 5 side walls 22, 23 include lead edges 17 and 18 respectively at the front end of the contact box 5. Each lead edge 17, 18 is angled from a forward point adjacent to the bottom wall 24 to a recessed point adjacent to the top wall 21.

When the contact is inserted through a seal hole, the seal slides over the front fold over flap 16 along the lead edges 17, 18 and over the top wall 21. Lead edges 17, 18 may be coined to provide additional protection against cutting or otherwise damaging the seal. A front aperture 58 is disposed above the front fold over flap 16 and is generally defined by the walls 21-24 of the contact box. The front aperture 58 receives a mating contact pin 60 (FIG. 11).

As shown in FIGS. 2-4, a contact pad 40 is provided in top wall 21. In the exemplary embodiment, the pad 40 includes a two-step dimple 48. The two-step dimple 48 allows the material to be stretched only one material thickness at a time. This assists in ensuring the strength of the dimple. Referring to FIG. 11, the mating pin 60, engages the contact pad 40 and the contact beam 25 on diametrically opposed surfaces of the mating pin 60.

Figure 8:
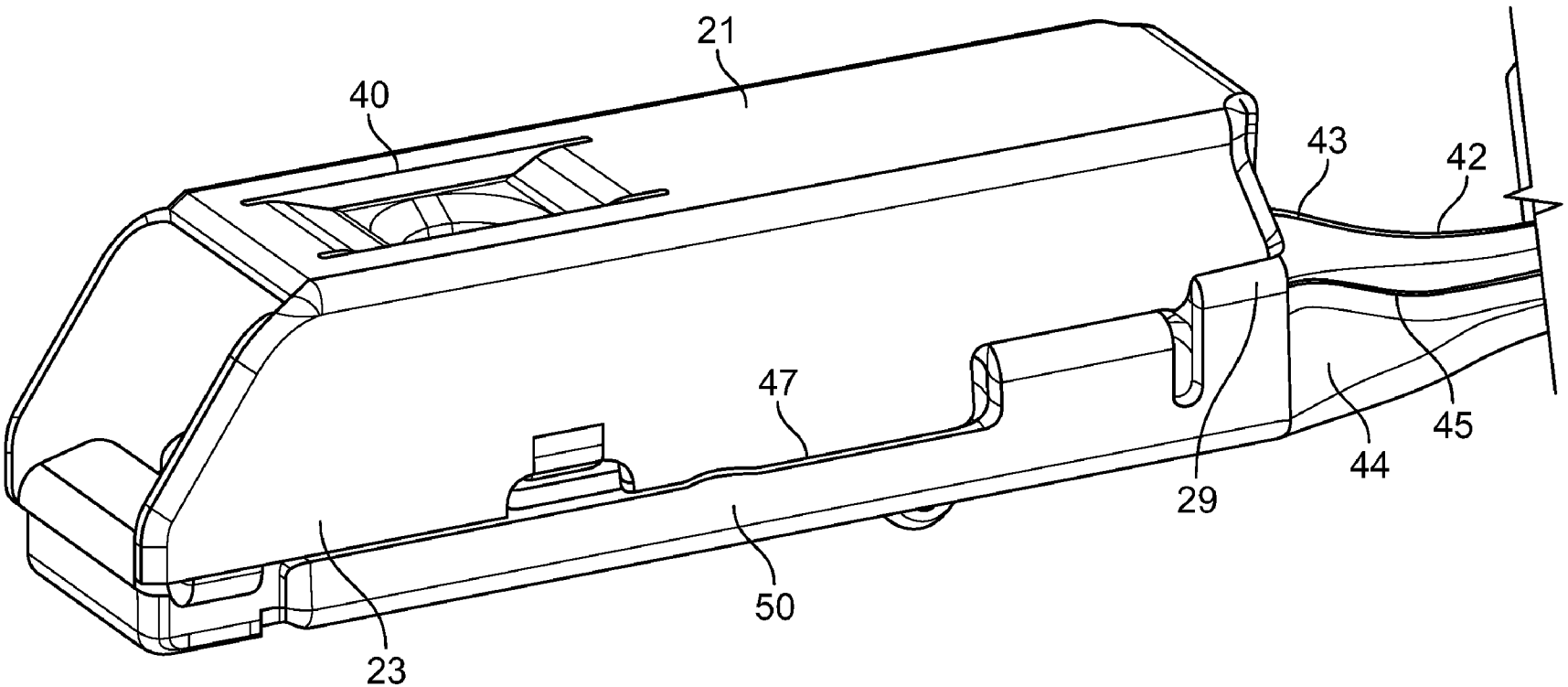
FIG. 8 shows a perspective view of the contact box 5 of the contact of FIG. 6.
Figure 9:
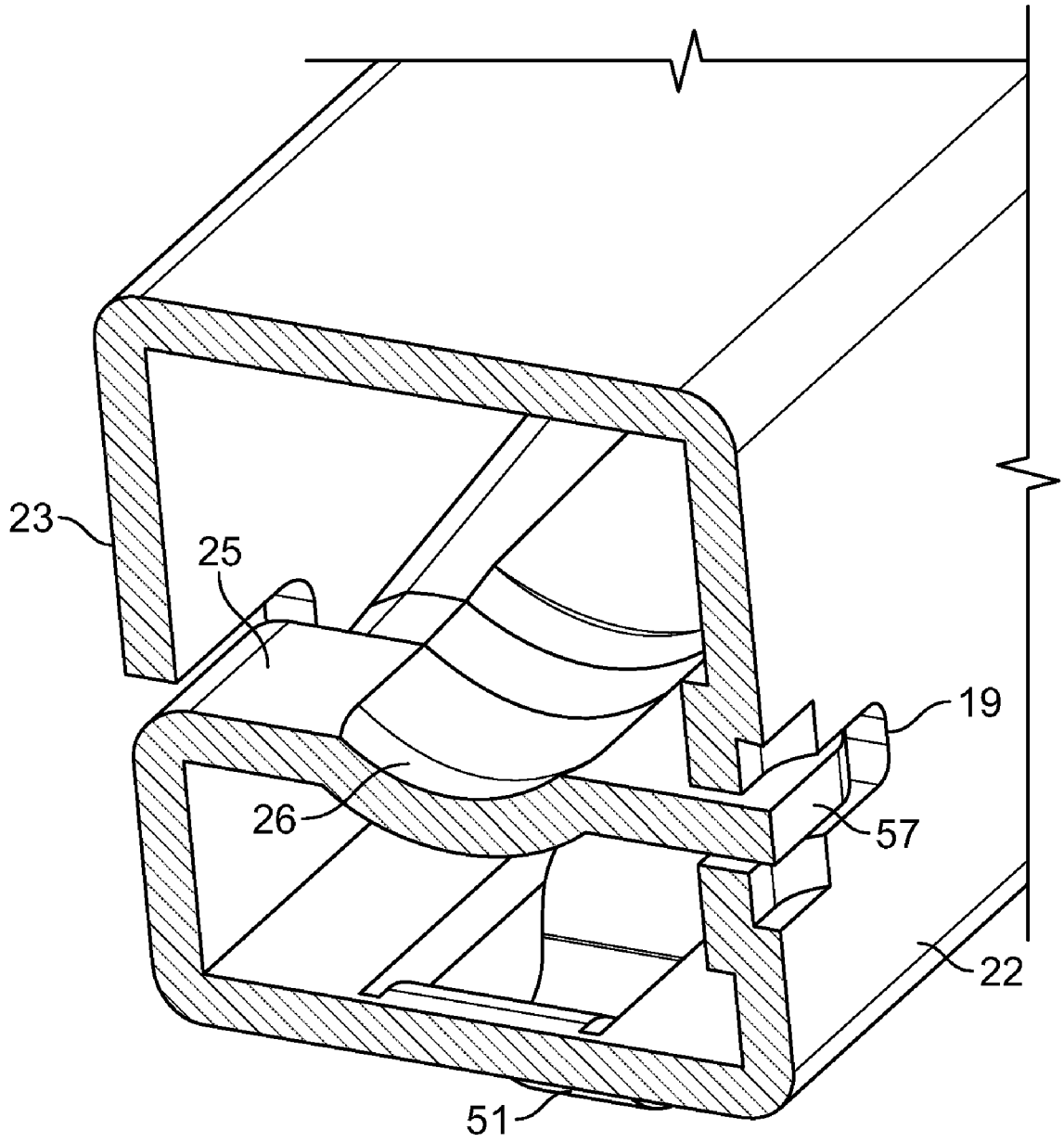
FIG. 9 shows a cross-section view of the contact beam locking feature taken along the lines 5-5 in FIG. 6.

An alternative embodiment of the contact 10 is shown in FIGS. 6-9. The alternative embodiment is similar to the embodiment shown in FIGS. 1-5 except that the contact beam 25 is formed from a flap along one side 23 of the contact box 5. This eliminates the overlapping top layer 31 of the first embodiment shown in FIGS. 1-5. As best shown in FIGS. 7 and 8, in the alternative exemplary embodiment, the contact box 5 includes a seam 47 along the side wall 23, instead of at the joint between the side wall 23 and the top wall 21 as in the first embodiment. As shown in FIG. 9, in this embodiment, the contact beam 25 is formed from one side 23 of the contact box 5 and locked in to the opposite side 22 of contact box 5. A locking tab 57 protrudes into a notch 19 in the opposite side wall 22. The dimensions of notch 19 may be adjusted to control the amount of float of the contact beam 25. As shown in FIGS. 7 and 8, the contact 10 also includes a rear strap 29. The rear strap 29 is configured to interact with a cut away 49 in the rear flap 12 to hold the seam 47 together at the rear of the contact box 5. Additionally, a lip 61 on the bottom of the side wall 23 hooks under the front fold over flap 16 and further lock the contact box 5 together.

As best shown in FIG. 8, the contact 10 may include a dimple 50, which aids in properly aligning the folded sides 23, 23*a* of the contact box 5. The dimple 50 provides additional material thickness that aids in preventing the contact 10 from roll over at the seam 47. The additional material thickness also strengthens the contact 10 from being crushed or flattened.

Figure 12:
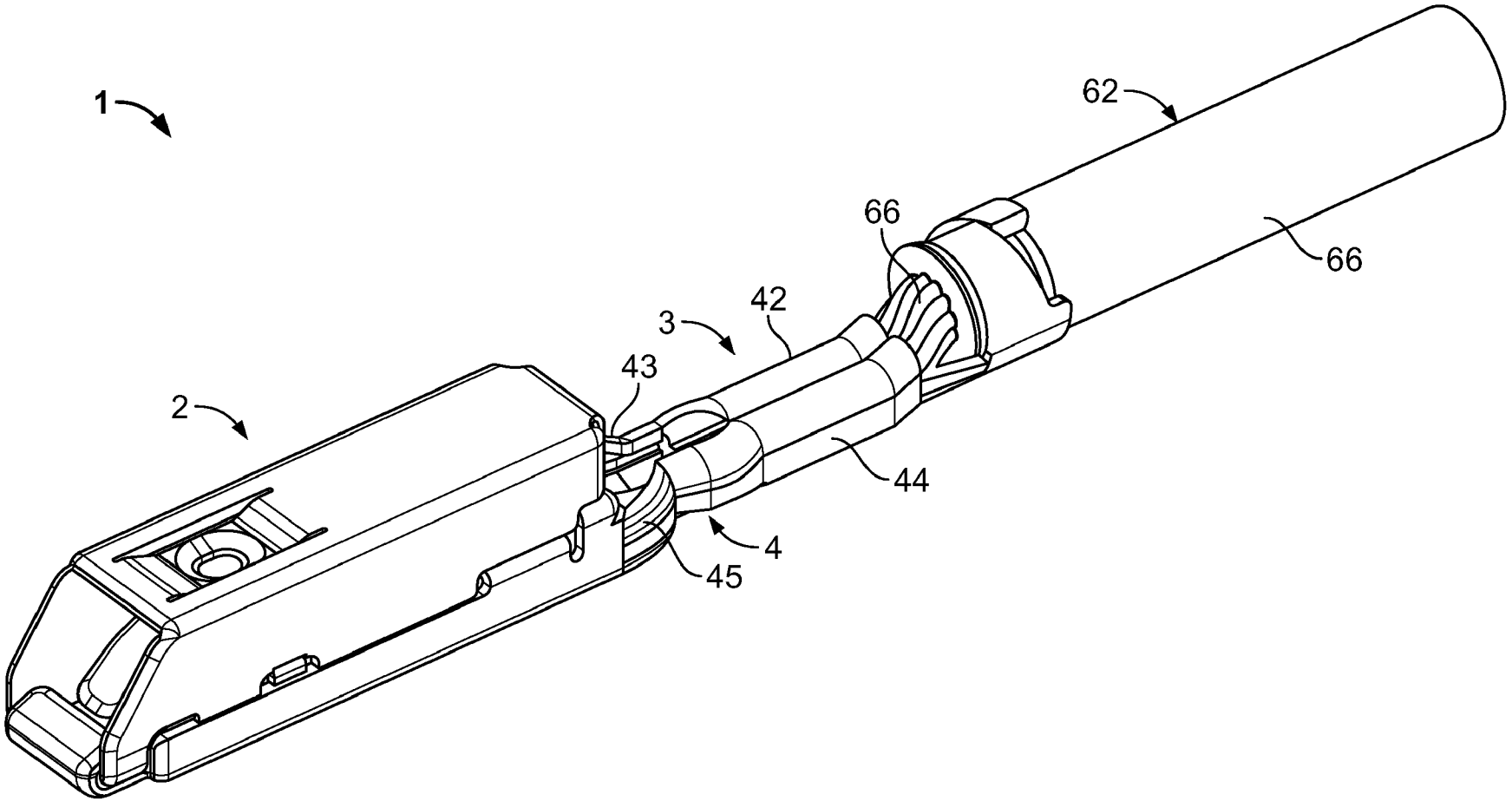
FIG. 12 shows a perspective view of the electrical contact crimped to an insulated stranded wire.

Referring next to FIG. 12, the electrical contact 1 is shown crimped to an insulated stranded wire 62. The insulated wire 62 includes an outer insulator jacket 64 surrounding a stranded wire 66. The wire 62 and connector 1 are physically and electrically joined by crimping sidewalls 42, 44 around stranded wire 66. The crimping may be performed by using a crimping tool. Specifically, crimping sidewalls 42, 44 causes the stranded wire 66 to be mechanically as well as electrically bonded with the crimp portion 3. Crimping mechanically deforms the sidewalls 42, 44 over the stranded wire 66. As mentioned previously, the angled top edges 43, 45 are partially formed inward from the side walls 42, 44 when crimped, to increase the bend strength of the crimp.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical contact comprising:

a mating portion, a crimp portion, and a transition region connecting the mating portion with the crimp portion;

the mating portion comprising:

a top wall and a bottom wall joined by two opposing side walls, wherein the top, bottom and two opposing side walls forming a contact box open at at least one end and configured to accept a mating second electrical contact;

the contact box comprises a contact beam having a free end extending therethrough, a front fold over flap and a front end aperture for insertion of a mating contact, and a back end adjacent to the transition region, wherein the front fold over flap protrudes partially into the front end aperture forward of the contact beam and is configured to prevent the free end of the contact beam from receiving a direct impingement force when mating the electrical contact with the mating second electrical contact; and wherein each of the side walls of the two opposing side walls comprise an angled front lead edge, each lead edge extending at an angle from a forward point adjacent to the bottom wall to a recessed point adjacent to the top wall.

2. The electrical contact of claim 1, wherein the contact beam is formed from a top flap portion extending from one of the two opposing side walls, and the top flap portion is folded beneath the top wall of the contact box to provide the top wall with a double layer.

3. The electrical contact of claim 1, wherein contact beam comprises a locking element configured to fix the position of the contact beam with respect to the side walls, the locking feature comprising a first wing and a second wing on the two opposing side walls of the contact beam, and the first and second wings configured to engage a first opening and a second opening disposed on opposing side walls, respectively.

4. The electrical contact of claim 1 wherein at least one side wall of the two opposing side walls includes a tab portion protruding inwardly into the contact box, the tab being disposed under a portion of the contact beam to limit a displacement distance of the contact beam upon insertion of a mating contact pin.

5. The electrical contact of claim 1, wherein the top wall includes a rear flap portion depending from the top wall adjacent the back section, the rear flap portion comprising a smooth surface for engaging an external seal of a connector cavity when an electrical contact is extracted from the connector cavity.

6. The electrical contact of claim 1, wherein at least one of the lead edges is coined or rounded to provide a smooth lead-in at the top wall of the contact box.

7. The electrical contact of claim 1, wherein the contact box further includes a dimple portion projecting inwardly into the contact box adjacent to the contact beam, the dimple configured to engage a side of a contact mating pin opposite the contact beam when the contact mating pin is inserted into the contact box.

8. The electrical contact of claim 1, wherein the contact beam comprises an embossment rib for achieving a predetermined beam stiffness and normal force.

9. The electrical contact of claim 8, wherein the embossment rib is tapered along a longitudinal axis of the contact beam and is tapered along an axis perpendicular to the longitudinal axis, wherein the embossment distributes mechanical stresses and provides a predetermined normal force between the contact beam and a mating contact.

10. The electrical contact of claim 1, wherein contact beam comprises a top flap portion, a back section and an interface section, wherein the top flap portion is disposed beneath and adjacent the top wall of the mating portion, and the back section is substantially perpendicular from the top flap portion, and the interface section is folded substantially perpendicular from the back section; the interface section extending between the top wall and bottom wall, and adjacent side walls.

11. The electrical contact of claim 10, wherein the back section comprises a first hole configured to project a light beam through the first hole to determine the separation distance between the contact beam and the top wall, the first hole being aligned with a gap defining a separation distance.

12. The electrical contact of claim 11, wherein the rear flap portion further includes a second hole in alignment with the first hole.

13. The electrical contact of claim 1, wherein the transition region comprises a bottom transition wall, a first transition side wall and a second transition side wall opposite the first side wall, the first transition side wall extending form the bottom transition wall to a first top edge, and the second transition side wall extending from the bottom transition wall to the second top edge, the first and second top transition edges being angled from the crimp portion to the mating portion side walls of the contact box, wherein the first and second transition side walls form a smooth engagement surface for contacting a seal portion.

14. The electrical contact of claim 1, wherein the first and second transition side walls top edges and configured to turn inward from the respective side wall when crimped.

15. The electrical contact of claim 1, wherein the contact beam is formed from an intermediate flap portion extending from a seam disposed along one of the side walls, and the intermediate flap portion is capable of being locked in to the opposing side wall.

16. The electrical contact of claim 15, wherein the contact beam comprises a singular locking tab, wherein the singular locking tab protrudes into a notch in the opposing side wall, the notch being configured to control the amount of deflection of the contact beam.

17. The electrical contact of claim 16, wherein the contact box also comprises a rear strap portion insertable into an aperture in the rear flap portion to secure the rear flap portion.

18. The electrical contact of claim 17, wherein the contact box further includes a lip portion at one of the first and second side wall, the lip portion configured to hook under the front fold over flap to interlock the corresponding side wall and bottom wall.

19. An electrical contact comprising:

a mating portion, a crimp portion, and a transition region connecting the mating portion with the crimp portion;

the mating portion comprising:

a top wall and a bottom wall joined by two opposing side walls, wherein the top, bottom and two opposing side walls forming a contact box open at at least one end and configured to accept a mating second electrical contact;

the contact box comprises a contact beam having a back section and a free end extending therethrough, a front fold over flap and a front end aperture for insertion of a mating contact, and a back end adjacent to the transition region, wherein the front fold over flap protrudes partially into the front end aperture forward of the contact beam from receiving a direct impingement force when mating the electrical contact with the mating second electrical contact; and wherein the back section comprises a first hole configured to project a light beam through the first hole to determine the separation distance between the contact beam and the top wall, the first hole being aligned with a gap defining a separation distance.

* * * * *